US009321065B2

(12) United States Patent
Betts et al.

(10) Patent No.: US 9,321,065 B2
(45) **Date of Patent: *Apr. 26, 2016**

(54) ACTUATOR CAP FOR A FLUID DISPENSER

(71) Applicant: Conopco, Inc., Englewood Cliffs, NJ (US)

(72) Inventors: Kassie Terra-Lynn Betts, Carlsbad, CA (US); Simon Lewis Bilton, Leamington Spa (GB); Adrian Barclay Caroen, Fulking (GB); Christopher John Jones, Tewkesbury (GB); Garen Kouyoumjian, Leamington Spa (GB)

(73) Assignee: Conopco, Inc., Englewood Cliffs, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/355,609

(22) PCT Filed: Oct. 9, 2012

(86) PCT No.: PCT/EP2012/069952

§ 371 (c)(1),
(2) Date: May 1, 2014

(87) PCT Pub. No.: WO2013/068190

PCT Pub. Date: May 16, 2013

(65) Prior Publication Data

US 2014/0299148 A1 Oct. 9, 2014

(30) Foreign Application Priority Data

Nov. 9, 2011 (EP) ..... 11188488

(51) Int. Cl.
*B65D 83/22* (2006.01)
*B65D 83/20* (2006.01)
(Continued)

(52) U.S. Cl.
CPC ..... *B05B 11/3059* (2013.01); *A45D 44/00* (2013.01); *B65D 83/205* (2013.01); *B65D 83/22* (2013.01); *B65D 83/34* (2013.01)

(58) Field of Classification Search
CPC B05B 11/032; B05B 11/3059; B05B 11/306; B65D 50/00; B65D 50/62; B65D 50/04; B65D 50/045; B65D 83/205; B65D 83/22
See application file for complete search history.

(56) References Cited

U.S. PATENT DOCUMENTS 3,734,354 A 5/1973 Gach
3,744,682 A 7/1973 Blank
(Continued)

FOREIGN PATENT DOCUMENTS

CN 1756715 4/2006
CN 102171111 8/2011
(Continued)

OTHER PUBLICATIONS

PCT International Search Report in PCT application PCT/EP2012/069952 dated Mar. 1, 2013 with Written Opinion.
(Continued)

*Primary Examiner* — Darren W Gorman
(74) *Attorney, Agent, or Firm* — Karen E. Klumas

(57) ABSTRACT

An actuator cap for dispensing a liquid product, comprising:
i) a rotatable outer body and an associated actuator button, the outer body comprising an inward projecting retaining clip and
ii) a non-rotatable chassis and an associated spray channel assembly, the non-rotatable chassis comprising a circumferentially extending slot into which the inward projecting retaining clip of the rotatable outer body fits;
the outer body and actuator button being rotatable between:
a first position in which the actuator button is incapable of depression and the inward projecting retaining clip of the rotatable outer body is held firmly in the circumferentially extending slot of the non-rotatable chassis and
a second position in which actuator button is capable of depression and the inward projecting retaining clip of the rotatable outer body is held less firmly in the circumferentially extending slot of the non-rotatable chassis.

10 Claims, 9 Drawing Sheets

(51) Int. Cl.

| | |
|---|---|
| ***B65D 50/04*** | (2006.01) |
| ***B05B 7/32*** | (2006.01) |
| ***B05B 11/00*** | (2006.01) |
| ***A45D 44/00*** | (2006.01) |
| *B65D 83/34* | (2006.01) |

(56) References Cited

U.S. PATENT DOCUMENTS

| | | | | |
|---|---|---|---|---|
| 3,844,448 | A | 10/1974 | Sette | |
| 3,860,149 | A | 1/1975 | Hagianis | |
| 3,937,368 | A | 2/1976 | Hoagland | |
| 4,024,988 | A | 5/1977 | Starrett | |
| 4,542,837 | A | 9/1985 | Rayner | |
| 5,158,206 | A | 10/1992 | Kobayashi | |
| 5,388,730 | A | 2/1995 | Abbott | |
| 6,302,302 | B1 | 10/2001 | Albisetti | |
| 6,758,373 | B2 | 7/2004 | Jackson | |
| 8,201,710 | B2 | 6/2012 | Helf | |
| 8,622,256 | B2 | 1/2014 | Campbell | |
| 2003/0150876 | A1 | 8/2003 | Walters | |
| 2003/0209569 | A1 | 11/2003 | Jackson | |
| 2005/0017027 | A1* | 1/2005 | Yerby | B65D 83/206 222/402.13 |
| 2005/0121474 | A1 | 6/2005 | Lasserre et al. | |
| 2007/0235474 | A1* | 10/2007 | Downey | B65D 83/205 222/153.11 |
| 2008/0023498 | A1 | 1/2008 | Bertin | |
| 2008/0116232 | A1 | 5/2008 | Michaux | |
| 2008/0164285 | A1 | 7/2008 | Hygema | |
| 2008/0210710 | A1 | 9/2008 | Marquardt | |
| 2009/0050650 | A1 | 2/2009 | Walters | |
| 2009/0218369 | A1 | 9/2009 | Carnacina | |
| 2010/0089950 | A1 | 4/2010 | Helf et al. | |
| 2010/0206907 | A1 | 8/2010 | Angus | |
| 2012/0024899 | A1 | 2/2012 | Michaux | |
| 2012/0292344 | A1 | 11/2012 | Bertin | |
| 2013/0075429 | A1 | 3/2013 | Houser | |
| 2013/0256338 | A1 | 10/2013 | Moreau | |
| 2014/0231467 | A1 | 8/2014 | Betts | |
| 2014/0299148 | A1 | 10/2014 | Betts | |
| 2014/0329918 | A1 | 11/2014 | Arora | |

FOREIGN PATENT DOCUMENTS

| | | | |
|---|---|---|---|
| DE | 29610372 | U1 | 10/1996 |
| EP | 0119084 | A2 | 9/1984 |
| EP | 1248731 | | 10/2002 |
| EP | 1248731 | B1 | 10/2005 |
| EP | 2143661 | A2 | 1/2010 |
| EP | 2049415 | B1 | 11/2010 |
| EP | 2591861 | | 5/2013 |
| FR | 2953497 | A1 | 6/2011 |
| GB | 1340320 | A | 12/1973 |
| JP | 53-080815 | U1 | 7/1978 |
| JP | 53080815 | | 7/1978 |
| JP | 62087765 | | 11/1985 |
| JP | 62087765 | A2 | 11/1985 |
| WO | WO0153157 | | 7/2001 |
| WO | WO0153157 | A2 | 7/2001 |
| WO | WO2007022422 | A2 | 2/2007 |
| WO | WO2008150810 | A1 | 12/2008 |
| WO | WO2010042431 | A1 | 4/2010 |

OTHER PUBLICATIONS

European Search Report in EP application EP 11 18 8488 dated Apr. 20, 2012.
PCT International Search Report in PCT application PCT/EP2012/069953 dated Jan. 4, 2013 with Written Opinion.
European Search Report in EP application EP 11 18 8487 dated Apr. 16, 2012.
Co-pending Application: Applicant: Betts et al., Filed: May 1, 2014.
PCT International Search Report in PCT application PCT/EP2012/070590 dated Mar. 7, 2013 with Written Opinion.
European Search Report in EP application EP 11 19 5105 dated Apr. 16, 2012.
PCT International Search Report in PCT application PCT/EP2012/069950 dated Mar. 5, 2013 with Written Opinion.
European Search Report in EP application EP 11 18 8489 dated Apr. 18, 2012.
PCT International Search Report in PCT application PCT/EP 2012/069949 dated Mar. 6, 2013 with Written Opinion.
European Search Report in EP application EP 11 18 8491 dated Apr. 20, 2012.
Snug, Merriam Webster, 2015, pp. 1-4.
IPRP1 in PCTEP2012069950, May 13, 2014, pp. 5-10.
IPRP1 in PCTEP2012069953, May 13, 2014, pp. 11-16.
IPRP2 in PCTEP2012069949, Dec. 9, 2013, pp. 17-22.
IPRP2 in PCTEP2012069952, Sep. 20, 2013, pp. 23-28.
IPRP2 in PCTEP2012070590, Dec. 12, 2012, pp. 29-34.
Search Report in EP11195105, Apr. 16, 2012, pp. 35-36.
Search Report in PCTEP2012070590, Mar. 7, 2013, pp. 37-41.
Written Opinion in EP11188487, Apr. 16, 2012, pp. 1-1.
Written Opinion in EP11188488, Apr. 20, 2012, pp. 2-4.
Written Opinion in EP11188489, Apr. 18, 2012, pp. 5-5.
Written Opinion in EP11188491, Apr. 20, 2012, pp. 6-8.
Written Opinion in EP11195105, Apr. 16, 2012. pp. 9-11.
Written Opinion in PCTEP2012070590, Mar. 7, 2013. pp. 12-16.
IPRP2 in PCTEP2014050667 dated Jul. 23, 2015. pp. 1-10.
Search Report in EP13154796 dated Jul. 23, 2013. pp. 11-12.
Search Report in PCTEP2014050667 dated Apr. 4, 2014. pp. 13-15.
Written Opinion 1 in PCTEP2014050667 dated Apr. 4, 2014. pp. 16-21.
Written Opinion 2 in PCTEP2014050667 dated Feb. 10, 2015. pp. 22-27.
Written Opinion 3 in PCTEP2014050667 dated May 6, 2015. pp. 28-33.
Written Opinion in EP1315796 dated Jul. 23, 2013. pp. 34-36.

* cited by examiner

ACTUATOR CAP FOR A FLUID DISPENSER

BACKGROUND OF THE INVENTION

Field of the Invention

The present invention is concerned with an actuator cap for a fluid container that allows the contents of the container to be sprayed without the cap having to be removed. The invention is of particular use in the field of home and personal care when it may be used as part of a hand held aerosol dispenser. A particular aspect of the invention is that the actuator enables the dispenser with which it is associated to be interchangeably converted between operative and inoperative states.

Sprays through actuator caps enabling conversion between operative and inoperative states, optionally for use with pressurised fluid containers, have been described in the prior art.

U.S. Pat. No. 4,542,837 (Metal Box) discloses an actuator having upper and lower rotatable parts which may be rotated between operative and inoperative positions.

EP 2,049,415 B1 (Valois) discloses a fluid dispensing head comprising actuator means for driving a pushbutton in axial displacement relative to the valve rod, the pushbutton being used to trigger dispensing.

It as an object of the present invention to provide a robust, yet ergonomically attractive dispensing means for spraying liquid products, particularly products intended for application to the surface of the human body.

It is a further object of the present invention to provide a dispensing means for spraying liquid products that is easy to manufacture and robust during shipping.

The invention is particularly suitable for applying cosmetic products to the surface of the human body, especially to the underarm regions of the human body.

BRIEF SUMMARY OF THE INVENTION

In a first aspect of the present invention, there is provided an actuator cap for dispensing a liquid product, comprising:

i). a rotatable outer body and an associated actuator button, the outer body comprising an inward projecting retaining clip and ii). a non-rotatable chassis and an associated spray channel assembly, the spray channel assembly comprising an outlet nozzle and the non-rotatable chassis comprising a circumferentially extending slot into which the inward projecting retaining clip of the rotatable outer body fits;

the outer body and actuator button being rotatable between:

a first position in which the actuator button is incapable of depression and the inward projecting retaining clip of the rotatable outer body is held firmly in the circumferentially extending slot in the rotatable outer body and a second position in which actuator button is capable of depression and the inward projecting retaining clip of the rotatable outer body is held less firmly in the circumferentially extending slot in the rotatable outer body.

In a second aspect of the present invention, there is provided a method for applying a cosmetic product to the surface of the human body comprising the use of an actuator cap according to the first aspect of the invention in combination with a supply of suitable cosmetic product.

In preferred embodiments, the slot in the chassis into which the inward projecting retaining clip from the outer body fits is radially wider in the second position than in the first.

In preferred embodiments, the actuator cap comprises means for driving rotation of the outer body towards completion. This can be to complete rotation to the primed position and/or rotation towards the fully closed position. This is typically achieved by means of leaf springs and/or rotational tension between non-circulation as described in more detail later.

Herein, orientation terms such as "horizontal/vertical" and "upper/lower" should be understood to refer to the actuator cap oriented in an upright manner as it would be on top of an upright aerosol can with which it is designed for use.

Herein, the "front" of the actuator cap refers to the face bearing the spray outlet; the "sides" are the faces orthogonal to this face and the "rear" is the face parallel to, but away from that bearing spray outlet. These terms have the same meaning (mutatis mutandis) when used with reference to components of the actuator cap and relate to the actuator cap in its "primed" position.

Herein, the actuator cap should be understood to be "primed", i.e., ready for actuation, when the actuator button is in its raised and tilted position ready for depression.

The components of the actuator cap are typically made from plastic. The outer body and chassis may be made from polypropylene, as may the spray channel. The swirl chamber, if employed, is typically made using a spray insert preferably made from acetal.

The features described with reference to the following specific embodiment may be incorporated independently into the generic description given above and/or as given in the claims.

BRIEF DESCRIPTION OF THE DRAWINGS

FIG. 13 is a side view with the nozzle projecting to the left; FIG. 14 is a side view with the nozzle projecting to the right and FIG. 15 is view from below and side, with slight offset to the rear.

DETAILED DESCRIPTION OF THE INVENTION

Figure 1:
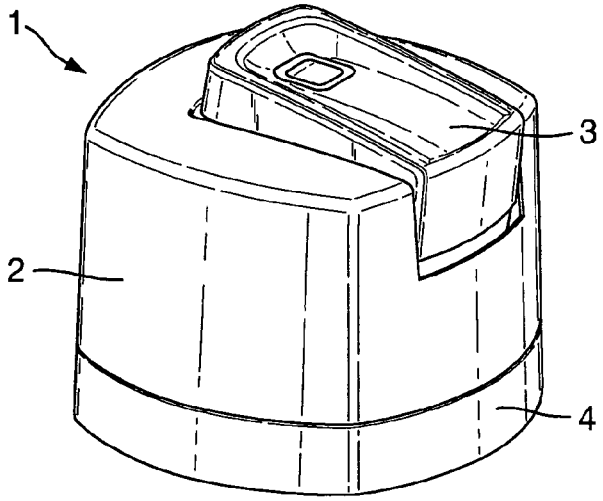
FIG. 1 is a view of an actuator cap (1) according to the present invention.

FIG. 1 shows an actuator cap (1) comprising a rotatable outer body (2), actuator button (3) and collar (4). The collar (4) is designed to fit over a pressurised fluid container (not shown) with which the actuator cap (1) is designed to be used. In this Figure, the actuator button (3) is in a raised and tilted position in preparation for actuation (vide infra). From this Figure and many of the others, it is clear that the overall cross-sectional shape of the actuator (1), in a horizontal plane, is non-circular, having what might be termed a rounded rectangular shape. Both the collar (4) and the outer body (2) have this cross-sectional shape.

Figure 2:
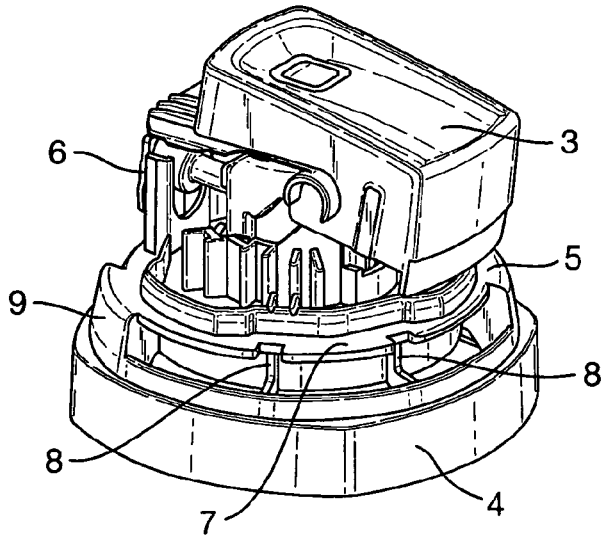
FIG. 2 is a view of the actuator cap (1) with the outer body (2) made invisible.

FIG. 2 shows the actuator cap (1) of FIG. 1 with the outer body (2) made invisible, revealing some of the internal features of the device. The collar (4) is part of a much more involved component, the chassis (5), more about which is said below. Many of the components of the chassis (5) sit on a platform (7) that is held in a raised position above the collar (4) by several connecting ribs (8 and 9), two of which (one illustrated, 9) are wider than the others and project outwards from the platform (7). The narrower connecting ribs (8), of which there are four (two shown), are recessed. These features are further illustrated in FIGS. 4, 5, and 6. These features are important to the interaction of the outer body (2) with the chassis (5) (vide infra). Visible in part in FIG. 6 is the spray channel assembly (6).

Figure 3:
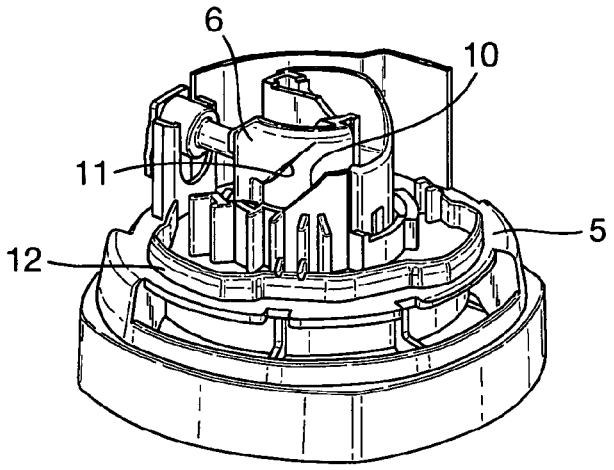
FIG. 3 is a view of the actuator cap (1) with the outer body (2) and actuator button (3) made invisible.

FIG. 3 illustrates the spray channel assembly (6) held snugly in the chassis (5). FIG. 3 also shows one of two cam surfaces or drive ramps (10) present on the chassis (5) and one of two cam surfaces or return ramps (11) present on the spray channel assembly (6). These cam surfaces are key to the operation of the actuator (vide infra). Also shown is a low wall (12) of convoluted shape rises from the platform (7) of the chassis (5) and extends approximately two-thirds the way around the platform (7), close to but not at its periphery. This wall (12) is important in the rotational operation of the actuator (1) (vide infra).

Figure 4:
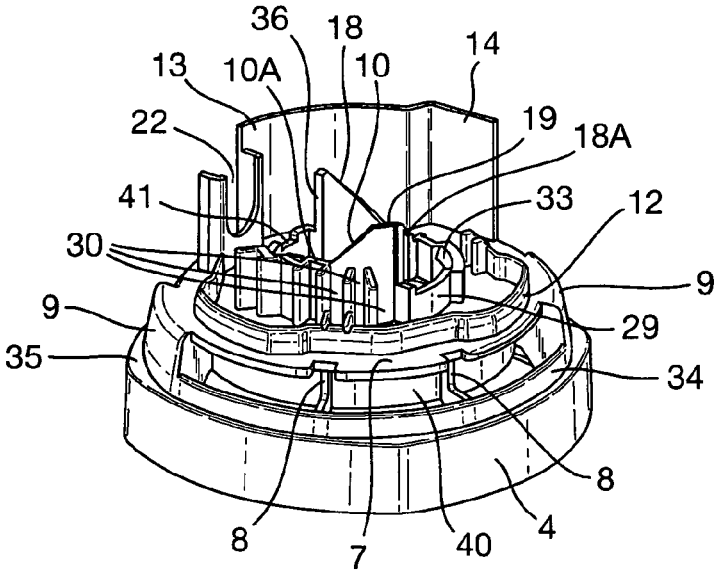
FIGS. 4, 5, and 6 are views of the chassis (5) from above and to the side (FIG. 4), from the top (FIG. 5) and from the bottom (FIG. 6).

FIG. 4 illustrates several of the features of the chassis (5). Features not previously discussed are the screen (13) and blanking plate (14). The blanking plate (14) serves to block off the aperture (16) in the skirt (17) of the outer body (2) when the actuator (1) is in its fully closed position (vide infra). The screen (13) serves a similar purpose when the actuator (1) is part way between its fully closed and fully open positions. There is a cut away section (22) at the end of the screen (13) farthest from the blanking plate (14) in which an obscuring plate (23) of the spray channel assembly (6) sits when the actuator cap (1) is fully assembled (vide infra).

Also illustrated in FIG. 4 are two cam surfaces or drive ramps (10 and 18). The drive ramps (10 and 18) protrude from the platform (7) and curve around facing portions of the edge of an aperture (26) in the chassis (5) (see FIG. 5), increasing in height in an anticlockwise direction. One of these drive ramps (10) is shorter than the other (18), as a result of starting at a higher point up the wall (12), of which they are both continuations. The shorter drive ramp (10) is truncated at its top, terminating in a short horizontal section (19) anticlockwise from the ramped section. Leading in to each of the drive ramps (10 and 18) from an anticlockwise direction are flat sections (10A and 18A, respectively. The drive ramps (10 and 18) have the same slope and terminate at the same height above the platform (7). The drive ramps (10 and 18) serve to force the actuator button (3) upwards by interaction with drive lugs (20 and 21) projecting inwards from the actuator button (3) when the actuator button (3) is rotated by turning the outer body (2) anticlockwise (vide infra).

Also illustrated in FIG. 4 is one of two retaining clips (33) that help hold the spray channel assembly (6) in place. These clips (also illustrated in FIGS. 5 and 6), have a top surface that slopes downwards towards the centre of aperture (26), this feature assisting the assembly of the actuator cap (1), in particular the insertion of the spray channel assembly (6) into the aperture (26) in the chassis (5).

The outer edge of the chassis (5) at its lower end is defined by the collar (4). Immediately above the collar (4) there is a short peripheral skirt (34) of almost circular profile. This skirt (34) projects upwards from a horizontal peripheral ledge (35) which links the bottom of the peripheral skirt (34) to the top of the collar (4).

Figure 7:
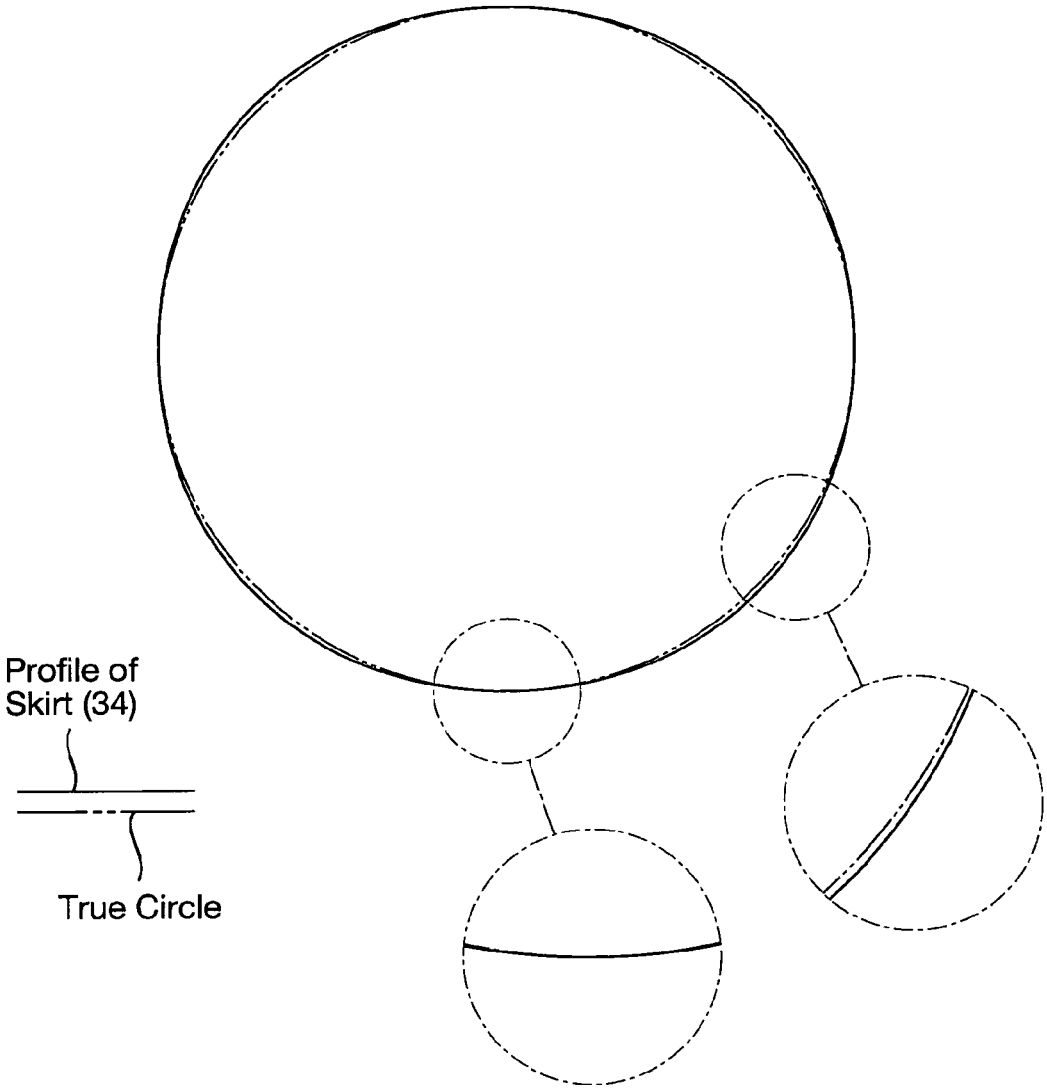
FIG. 7 a view the outer profile of the skirt (34) section of chassis (5) and how it differs from circular.

When the actuator cap (1) is assembled, the lower edge of the outer body (2) sits upon the peripheral ledge (35). Interaction between the inner surface of the outer body (2), which has "rounded rectangular" cross-section and the outer surface of the peripheral skirt (34), which has an almost but not quite circular profile (see FIG. 7), leads to rotational tensioning. Tension is reduced when the "corners" of the outer body (2) are located adjacent to the outer edge of the peripheral skirt (34) at its wider points, such that the narrower cross-sectional dimensions of the outer body (2) are located adjacent to the skirt (34) where it has its narrower cross-sectional dimensions. These interactions tend to ease rotation of the outer body (2) towards its positions where the tensions are minimised. The design is such that these tensions are minimised when the actuator cap (1) is in its fully open or fully closed position; hence, the outer body (2) is encouraged towards these rotational positions when close thereto.

There are two slots (40) between the platform (7) and the peripheral ledge (35). These slots (40) comprise gaps existing in both vertical and horizontal planes. The vertical gap is constant across the full dimensions of the components, the platform (7) being held at the same height above the surrounding peripheral ledge (35) across all its extent. The radial gap between the platform (7) and the ledge (35) varies radially, decreasing steadily in width in a clockwise direction starting from the points adjacent to the clockwise edges of the wider connecting ribs (9). This may most clearly be seen in FIGS. 5 and 6. The decreasing width of the slots (40) in this plane is caused by a corresponding increase in the size of the platform (7). This variation in the radial width of the slots (40) has marked advantage in the balance between ease of manufacture and the in use robustness of the assembled actuator cap (1) (vide infra).

Figure 5:
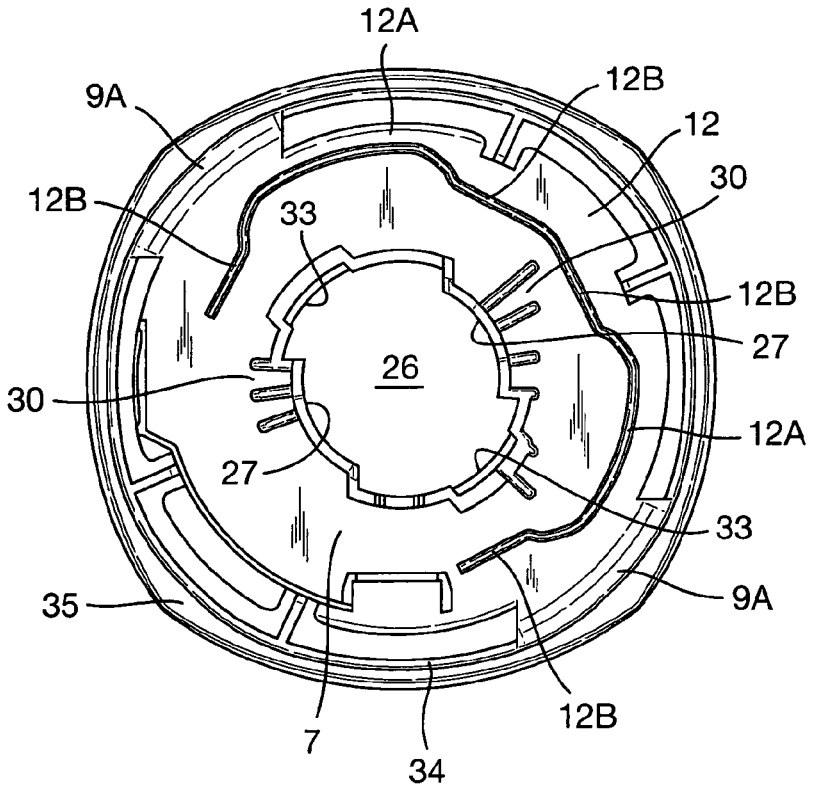
Figure 6:
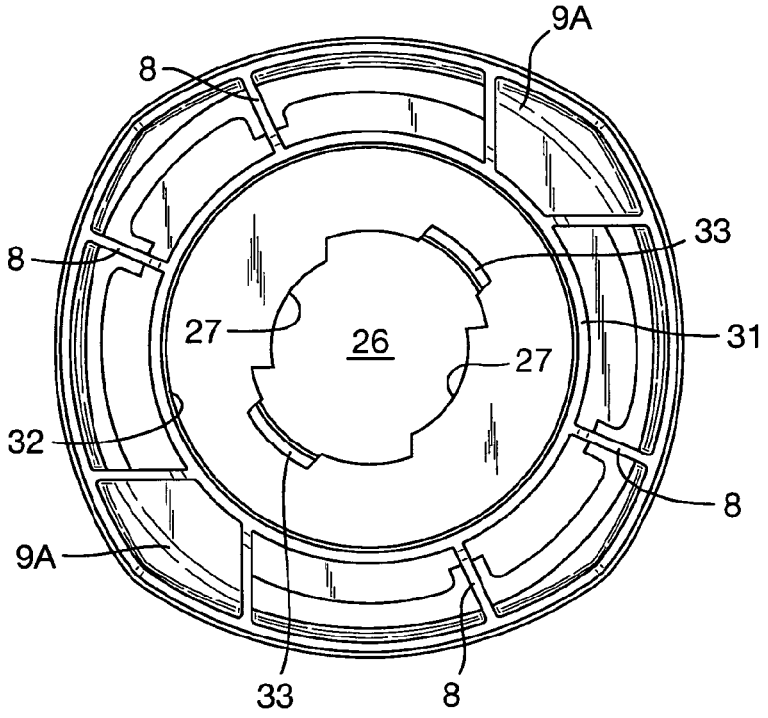

FIG. 5 shows the path of the low wall (12) of convoluted shape that rises from the platform (7) of the chassis (5). This wall interacts with two leaf springs (24) projecting downwards from the inside surface of the top wall (25) of the outer body (2) (vide infra). The lower ends of the leaf springs (24) sit outside of the low wall (12) and are tensioned when outside the sections of the wall (12) farthest from the centre (labelled 12A). The tension in the leaf springs (24) serves to drive rotation of the outer body (2) towards the positions in which the leaf springs (24) sit outside the sections of the wall (12) nearest to the centre (labelled 12B) when the rotational of the outer body (2) is such that the lower ends of the leaf springs (24) are located on sections of the wall (12) sloping between the sections farthest (12A) and nearest (12B) to the centre.

The location of the leaf springs (24) is such that their lower ends sit outside the sections of the low wall (12B) nearest to the centre of the chassis (5) when the actuator cap (1) is in its fully open or fully closed position; hence, the leaf springs serve to drive the outer body (2) towards these rotational positions when close thereto.

The chassis has a central aperture (26) into which the spray channel assembly (6) is designed to fit snugly. The aperture (26) is roughly circular in cross-section, but has distinct narrowed sections (27) that interact with narrowed sections on the body (28) (see FIG. 15) of the spray channel assembly (6) to restrict rotation of the latter when in the aperture (26). From the edge of the central aperture (26), a wall (29) of varying height (most clearly seen in FIG. 4) rises from the platform (7). The aforementioned drive ramps (10 and 18) are extensions of this wall (29) where it surrounds the narrowed sections (27) of the aperture (26). At these sections (27), the wall (29) has strengthening support struts (30) radiating outwards from its outer edge and abutting the platform (7), as illustrated in FIGS. 4 and 5. Each of the drive ramps (10 and 18) has a vertical edge (36), see FIG. 4, at its anticlockwise extremity, this being important in the achieving spray release when the actuator cap (1) is primed (vide infra). At a location on the wall (29) radially matching the position of the cut-away section (22) at the end of the more externally located screen (13), the wall (29) has a concave cut (41) for retention of a cross-stem (42) of spray channel assembly (6) when at its lowest (dispensing) position (vide infra). The radial position of the concave cut (41) is shortly anticlockwise of the vertical edge (36) defining the anticlockwise extremity of the longer drive ramp (18), this drive ramp (18) radially matching the position of the more externally located screen (13).

FIG. 6 shows a valve cup ring (31) which protrudes downwards from the underside of the chassis (5) and which fastens to the valve cup of an aerosol can when the actuator cap (1) is in use. The valve cup ring (31) has an internal bead (32) to help facilitate this fastening. FIG. 6 also illustrates the underside of the connecting ribs (8 and 9). The narrower ribs (8) project radially from the outer edge of valve cup ring (31) to the inner edge of the peripheral skirt (34) and collar (4). The wider ribs (9) are comprised of curved peripheral sections (9A) linking the edge of the platform (7) to the top edge of the peripheral skirt (34) and inwardly angled support projections (9B) connecting the outer edge of the valve cup ring (31) to the inner edge of the peripheral skirt (34) and the collar (4).

Figure 8:
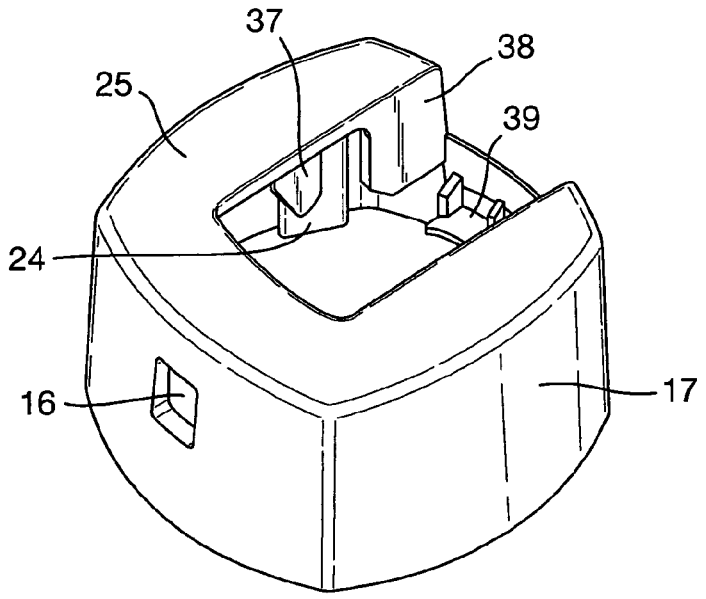
FIG. 8 is a view of the outer body (2) from above, front, and side.

FIG. 8 shows that the outer body (2) has an upper surface (25) and a skirt (17) dependent therefrom. In a front portion of the skirt (17) there is an aperture (16) for the spray channel assembly (6) to be able to discharge from when the actuator cap (1) is primed. The upper surface (25) and an upper rear part of the skirt (17) facing the aperture (16) have a cut-away segment for incorporation of the actuator button (3) (vide infra). The part cut-away from the upper surface (25) has parallel edges towards the sides and a roughly orthogonal, but outwardly curved, edge towards the front.

One of the two leaf springs (24) is part illustrated in FIG. 8, as is one of two downward projections (37) from the middle of both parallel edges of the cut-away segment of the upper surface (25). There are also downward projections (38) from either side of the parallel edges of the cut-away segment that border the cut-away segment in the skirt (17). These downward projections (37 and 38) serve to help guide the actuator button (3).

FIG. 8 also illustrates one of two retaining clips (39) that help hold the outer body (2) in place on the chassis (5). These clips (39) fit into the slots (40) between the platform (7) and the skirt (34) of the chassis (5) and are circumferentially bounded by the edges of the wider connecting ribs (9) between these features (see FIG. 4). Rotation of the clips (39) between the bounds of the connecting ribs (9) is possible in part because of the recessed nature of the narrower connecting ribs (8) located in-between.

During the manufacture of the dispensing cap (1), the retaining clips (39) are pushed through the slots (40) in the chassis (5) where the latter have their maximum radial width (vide supra), this easing manufacture. This corresponds to a radial positioning of the outer body (2) relative to the chassis (5) as present when the actuator cap is in its primed position. Following insertion, the retaining clips (39) are rotated in the slots (40) in the chassis (5) to the position where the latter have their minimum radial width, this corresponding to a radial positioning of the outer body (2) relative to the chassis (5) as present when the actuator cap is in its fully closed position. This serves to provide a high strength link between the outer body (2) and the chassis (5) when it is most needed, the consumer typically receiving the actuator cap (1) in a fully closed condition, together with an associated aerosol can, and proceeding to mistakenly attempt to pull off the actuator cap (1), believing it to be a conventional over-cap.

Figure 9:
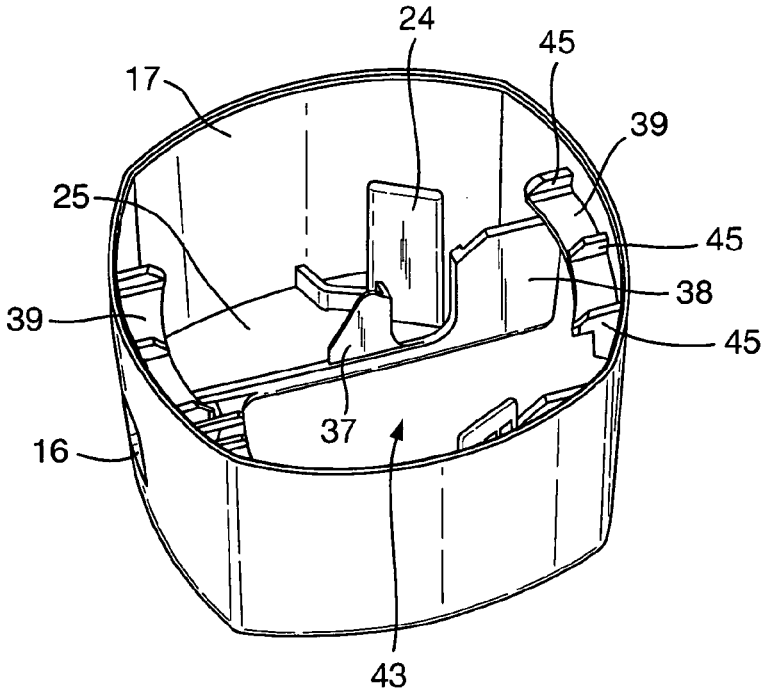
FIG. 9 is a view of the outer body (2) from below and side.

FIG. 9 illustrates that between the downward projections (37 and 38) from each side of the upper surface (25) of the outer body (2) bordering the cut-away segment thereof, there is a concave curved depression or yoke (43). These concave yokes (43) (only one visible in FIG. 9) serve an important function in conjunction with elements of the actuator button (3) (vide infra).

Figure 10:
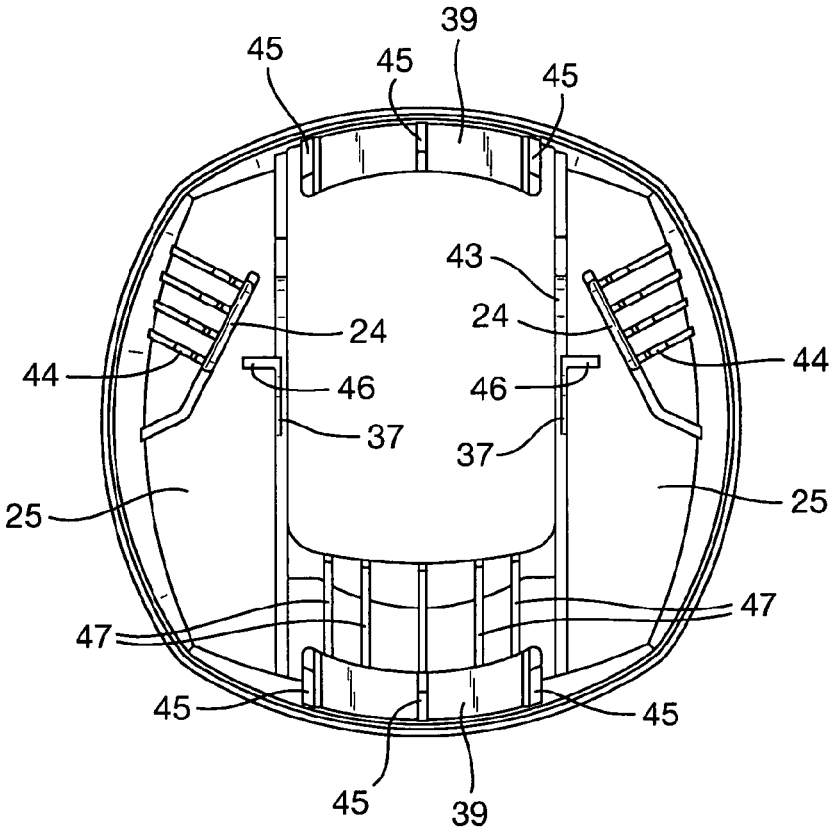
FIG. 10 is a view of the outer body (2) from below.

FIGS. 9 and 10 illustrate several of the strengthening features of the outer body (2). The leaf springs (24) are each reinforced by four support struts (44) projecting from their outer surfaces are bracing against the inside surface of the top wall (25).

The retaining clips (39) are each strengthened by three support struts (45) that project downwards from their lower surfaces and brace against the inside of the skirt (17) at its front and rear. Two of the support struts (45) for the retaining clips (39) are located at the edges of the retaining clips (39) and project upwards as well as downwards. These edge support struts (45) also serve as rotational stops when they come up against an the edges of the wider connecting ribs (9) that define the edge of the slots (40) in the chassis (5) into which the retaining clips (39) are designed to fit. The retaining clip support struts (45) are chamfered on their lower edges to ease insertion of the clips (39) into the slots (40) in the chassis (5).

The downward projections (37) from the middle of both parallel edges of the cut-away segment of the upper surface (25) are strengthened by orthogonal walls (46) that project outwards from their rear edges. These orthogonal walls (46) also help to guide the actuator button (3) in its movement within the actuator cap (1) (vide infra).

The front segment of the upper surface (25) of the outer body (2) is reinforced on its inner side by four support ribs (47) running in parallel from front to back.

Figure 11:
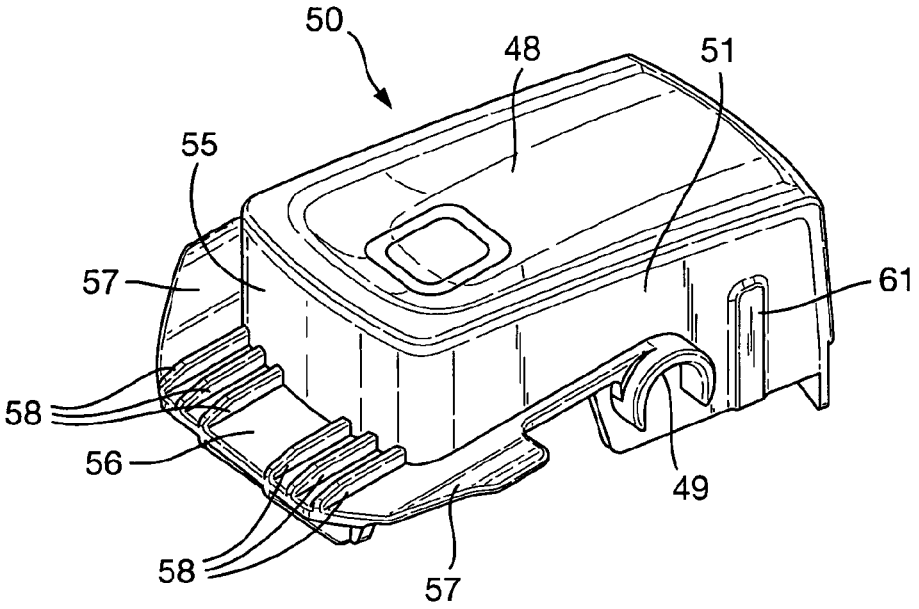
FIG. 11 is a view of the actuator button (3) from above, front and side and FIG. 12 a view of the actuator button (3) from below, front and side.

FIG. 11 shows some of the top and side features of the actuator button (3). There is a finger pad (48) upon its top face (50) and pinions (49) (one shown) are symmetrically disposed upon its side walls (51). The top face (50) is of same dimensions as the cut-away segment of the top wall (25) of the outer body (2) and completely fills this aperture when the actuator cap (1) is in its fully closed position. During anticlockwise rotation, the top face (50) of the actuator button (3) rises from being in the same plane as the upper surface (25) of the outer body (2), when the cap (1) is fully closed, through a position in which the top face (50) is raised but parallel to the upper surface (25), to a fully open or primed position in which the top face (50) is raised and sloping upwards (rear to front) relative to the upper surface (25). In the latter two positions, the side walls (51) of the actuator button (3) are visible in part, the actuator button protruding from the top surface (25) of the outer body (2) in these positions.

The side walls (51) of the actuator button (3) bearing the pinions (49) are actually located towards the front and rear of the actuator cap (1) when it is in its fully closed position; however, anticlockwise rotation of the upper body (2) and associated actuator button (3) through 90° puts the device in its fully open or primed position, in which position the pinions (49) are located towards the sides of the actuator cap (1) as a whole. During the aforementioned rotation, the pinions (49) move up the channels existing between the downward projections (37 and 38) from the middle and rear (respectively) of the parallel edges of the cut-away segment of the upper surface (25) of the outer body (2), guided in part by the orthogonal walls (46) projecting outwards from the rear edges of the middle projections (37), and when fully elevated, sit in the concave depressions or yokes (43) at the top of said channels. In this latter position, the final anticlockwise rotation of the upper body (2) and associated actuator button (3) causes the actuator button (3) to pivot about an axis through the through its pinions (49), resulting in the actuator button (1) becoming raised at its front edge (vide infra).

Figure 12:
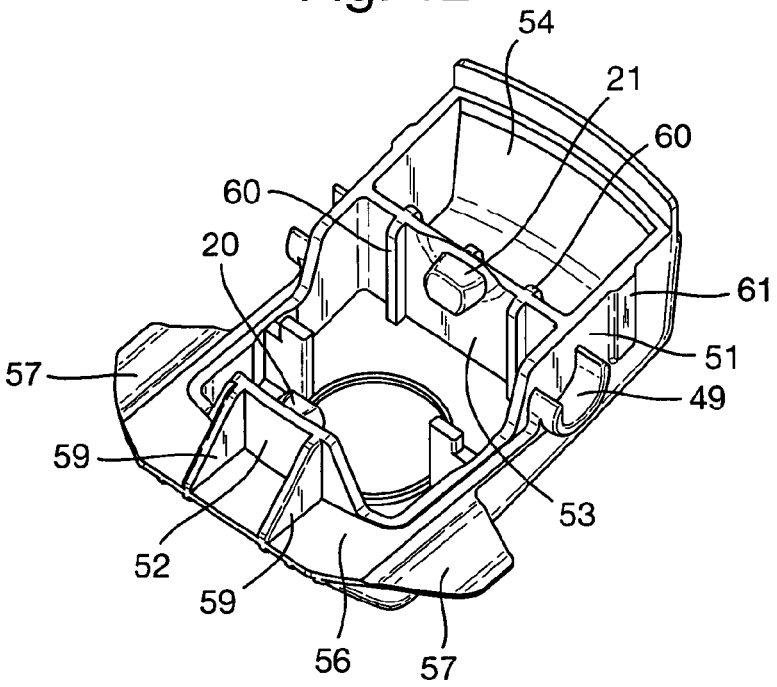

Key components of the actuator button (3) shown in FIG. 12 are inward projecting drive lugs (20 and 21). Projecting from a downwardly projecting front plate (52) of the button (3) is the front drive lug (20). Projecting from the front-facing surface of an internal cross-wall (53) just behind the axis between the pinions (49) of the button (3) is the rear drive lug (21). The front-back positioning of the rear drive lug (21) is in the same vertical plane as the axis between the pinions (49).

The drive lugs (20 and 21) are of the same dimensions and face one another in the same front-back plane; however, the front drive lug (20) is located somewhat lower in the actuator button (3) than the rear drive lug (21). The front drive lug (20) sits on the longer drive ramp (18) of the chassis (5) and the rear drive lug (21) sits on the shorter drive ramp (10) of the chassis (5). When the actuator cap (1) is in its fully closed position, the actuator button (3) is level with the top wall (25) of the outer body (2) because the height difference between the front drive lug (20) and the rear drive lug (21) equates to the height difference at which the longer drive ramp (18) and the shorter drive ramp (10) commence. As anticlockwise rotation of the outer body (2) and associated the actuator button (3) commences, the actuator button (3) rises without slanting because the drive ramps (18 and 10) upon which the drive lugs (20 and 21) sit have the same slope. When the rear drive lug (21) reaches the horizontal section (19) of the shorter drive ramp (10), it does not rise further, unlike the front drive lug (20) which continues to rise further along the longer drive ramp (18), thereby producing a tilt in the actuator button (3), it being raised at the front at this rotational position.

When the drive lugs (20 and 21) have passed just beyond the end of their corresponding drive ramps (18 and 10), further anticlockwise rotation is prevented by the retaining clips (39) abutting the edges of the wider connecting ribs (9) spanning the slots (40) in the chassis (5). In this position, the actuator cap (1) is primed and the actuator button (3) may be depressed. The drive lugs (20 and 21) serve a second but equally important function during actuation. Having passed beyond the vertical edges (36) at the anticlockwise ends of their drive ramps (18 and 10), they are not blocked from depression. Downward force on the actuator button (3) causes the drive lugs (20 and 21) to press down upon the spray channel assembly (6) and this leads to actuation and release of product through the spray channel assembly (6).

If the actuation button (3) were to be pressed centrally, depression would in theory occur in a balanced fore and aft manner, each of the drive lugs (20 and 21) bearing down on the actuation spray assembly (6) and thereby avoiding possible lateral stress on the valve stem associated with the spray channel assembly (6) (vide infra).

In reality, the consumer tends to press the actuator button (3) more towards its rear, behind the axis of the pinions (49). This causes the actuator button (3) to pivot on its front edge and for pressure to be applied to the spray channel assembly (6) through the rear drive lug (21) rather than the front drive lug (20). This leads to distinct mechanical advantage because pressure is brought to bear on the spray channel assembly (6) closer to the pivot point than where it is applied. Indeed, it has been found that operation of actuator cap (1) in this manner can lead to an up to 1.6 times mechanical advantage. Fortunately, this "uneven" pressure application upon the spray channel assembly (6) is not transferred to the valve stem with which it is in use associated because the spray channel assembly (6) is held snugly in the aperture (26) in the intervening chassis (5).

Other components of the actuator button (3) are as follows. There is a rear wall (54) that is designed to fill the cut-away section in the upper rear part of the skirt (17) facing the aperture (16). There is a front wall (55). The downwardly projecting front plate (52) is a partial continuation of this front wall (55). The is a platform (56) extending forward from the front wall (55) and also outwards front the side walls (51) as flexible wing structures (57) which slope upwards as they extend outwards. The platform (56) and associated flexible wing structures (57) are designed to fit under the top wall (25) of the outer body (2) and the front-back angle of these features is such that they are in the same plane as the top wall (25) of the outer body (2) when the actuator button (3) is fully tilted and the actuator cap (1) is primed. In this position, the platform (56) and associated flexible wing structures (57) are pressed against the under surface of the top wall (25) of the outer body (2), flattening out the upward slope of the flexible wing structures (57).

In addition, the actuator button (3) has multiple (six) outward projecting strengthening ribs (58) on the upper surface of the part of the platform (56) extending forward from the front wall (55). The downwardly projecting front plate (52) has two support wedges (59) between it and the lower side of the platform (56) extending forward from the front wall (55). The internal cross-wall (53) has support ribs (60) projecting fore and aft. The side walls (51) each have a thin, outward-projecting, vertical rib (61) located just to the rear of the pinions (49). These ribs (61) lightly contact the inner faces of the downward projections (38) from the parallel edges of the segment cut-away from the top wall (25) of the outer body (2) and help to prevent undesirable sideways roll of the actuator button (3) when it is depressed.

Figure 13:
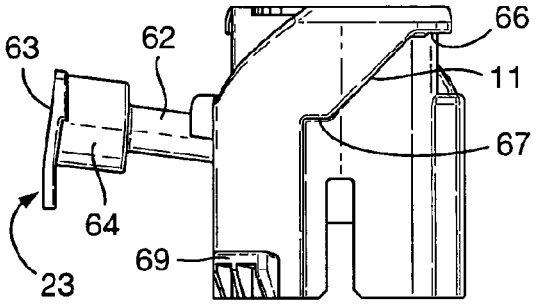
FIGS. 13, 14, and 15 are each views of the spray channel assembly (6)
Figure 14:
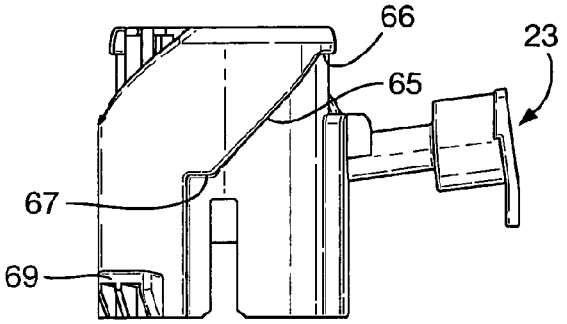
Figure 15:
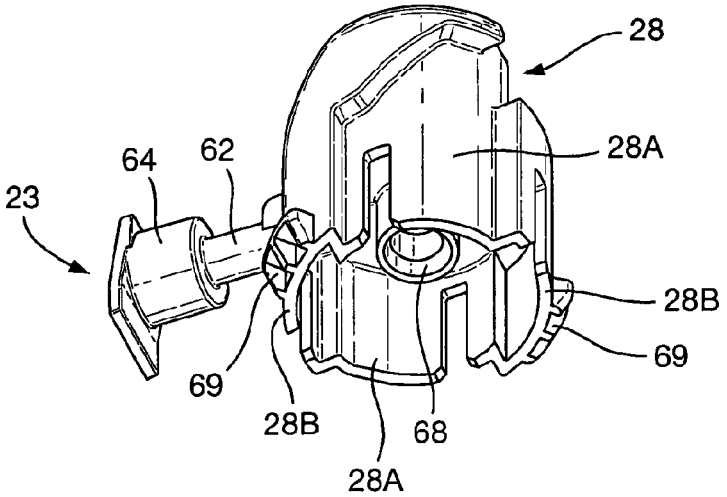

FIGS. 13 to 15 illustrate various aspects of the spray channel assembly (6). The main body (28) is of roughly circular cross-section, but has narrowed sections (28A) that fit within the narrowed sections of the aperture (26) in the chassis (5) (vide supra). Projecting outwards from the upper region of the main body (28) is a radial nozzle tube (62), terminating in the outlet nozzle (63). The spray issuing from the spray orifice (63) further atomised by a spray chamber (64) sitting at the end of the radial nozzle tube (62). The radial nozzle tube (62) slopes slightly upwards as it extends outwards. The spray orifice (63) is surrounded by the obscuring plate (23) that fills the cut away section (22) at the end of the screen (13) farthest from the blanking plate (14) of the chassis (5) (vide supra).

From the underside of the spray channel assembly (6) in the centre there protrudes a tubular stem socket (68), designed to accommodate the valve stem of an associated aerosol container. The stem socket (68) is in fluid communication with the spray orifice (63) through the spray chamber (64) and other internal channels not illustrated but common in the art.

From the outer surface of the main body (28) at its lower end, two retaining clips (69) protrude from the "non-narrowed" or wider segments (28B) of the main body (28), on opposite sides of said main body (28). These retaining clips (69) fit underneath the corresponding retaining clips (33) that protrude into the central aperture (26) of the chassis (5) (vide supra) and help to hold the spray channel assembly (6) and the chassis (5) together.

There are two return ramps (11 and 65) of the same slope curving around opposite outside surfaces of the main body (28). These return ramps (11 and 65) sit above the drive lugs (21 and 20, respectively) projecting inwards from the actuator button (3) and serve to force the actuator button (3) downwards when the outer body (2) is rotated clockwise. The return ramp (65) to the left of the spray orifice (63) is longer than the return ramp (11) to the right of the spray orifice (63), viewing the actuator cap (1) from the front. The length of the longer return ramp (65) corresponds to the length of the longer drive ramp (18) and the front (lower) drive lug (20) sits between these ramps. The length of the shorter return ramp (11) corresponds to the length of the shorter drive ramp (10) and the rear (higher) drive lug (20) sits between these ramps.

The return ramps (11 and 65) have flat sections (66 and 67) at their upper and lower ends (respectively). The gap between the lower flat sections (67) and the flat sections (10A and 18A) leading into the corresponding drive ramps (10 and 18) on the chassis (5) is slightly less than the height of the drive lugs (21 and 20) that is forced between them as the outer body (2) is rotated to its fully clockwise position. As the chassis (5) is in fixed axial position, this causes an upward force on the spray channel assembly (6), resulting in a slight lifting of the stem socket (68) from the valve stem (not illustrated) with which it is associated in use, creating a "safety gap" when the actuator is in its closed position.

The invention claimed is:

1. An actuator cap for dispensing a liquid product, comprising:

i). a rotatable outer body and an associated actuator button, the outer body comprising an inward projecting retaining clip and ii). a non-rotatable chassis and an associated spray channel assembly, the spray channel assembly comprising an outlet nozzle and the non-rotatable chassis comprising a circumferentially extending slot into which the inward projecting retaining clip of the rotatable outer body fits;

the outer body and actuator button being rotatable between:

a first position in which the actuator button is incapable of depression and the inward projecting retaining clip of the rotatable outer body is held firmly in the circumferentially extending slot in the non-rotatable chassis and a second position in which actuator button is capable of depression and the inward projecting retaining clip of the rotatable outer body is held less firmly in the circumferentially extending slot in the non-rotatable chassis;

the slot in the chassis into which the inward projecting retaining clip from the outer body fits is radially wider in the second position than in the first and wherein the fit of the retaining clip into the slot tightens on rotation from the second rotational positioning to the first.

2. An actuator cap according to claim 1, wherein the first relative rotational position corresponds to the position of the features at purchase.

3. An actuator cap according to claim 1, wherein rotation of the outer body from its first position to its second position uncovers the outlet nozzle of the spray channel assembly.

4. An actuator cap according to claim 3, wherein the outer body is more easily fitted to the chassis in the second rotational position relative to the first relative rotational position.

5. An actuator cap according to claim 1, further comprising an additional inward projecting, retaining clip and an additional circumferentially extending in the non-rotatable chassis into which the additional inward projection retaining clip fits.

6. An actuator cap according to claim 1, wherein the actuator button is raised in the second rotational position but not in the first rotational position.

7. An actuator cap according to claim 6, wherein the elevation of the actuator button is achieved through cam means acting between the actuator button and the chassis.

8. An actuator cap according to claim 7, wherein the cam means comprise drive ramps around a curved up-standing wall within the chassis and drive lugs projecting inwards from the actuator button that ride on said drive ramps.

9. An actuator cap according to claim 1, wherein the spray channel assembly is held snugly in a central aperture in the chassis.

10. An actuator cap according to claim 6, wherein rotation of the outer body from its first position to its second position causes the actuator button to rise and tilt upwards at its end closest to the outlet nozzle from the spray channel assembly.

* * * * *